United States Patent [19]

Piaget et al.

[11] 3,960,427

[45] June 1, 1976

[54] RETAINER FOR AN END FITTING OF A WELDING CABLE

[75] Inventors: Robert E. Piaget; Charles W. Clyburn, both of Cincinnati, Ohio

[73] Assignee: I.C.M. Industries, Inc., Blue Ash, Ohio ; a part interest

[22] Filed: Oct. 31, 1974

[21] Appl. No.: 519,577

[52] U.S. Cl. ..... 339/39; 174/138 F; 339/263 R

[51] Int. Cl.[2] ..... H01R 13/44

[58] Field of Search ..... 339/26, 36, 37, 39, 339/114, 116, 224, 232, 263, 272; 174/138 F; 151/69

[56] References Cited

UNITED STATES PATENTS

| | | | |
|---|---|---|---|
| 2,446,007 | 7/1948 | Hook | 339/26 |
| 2,875,266 | 2/1959 | Fredericks | 174/138 F |
| 3,601,757 | 8/1971 | Gober | 339/39 |

*Primary Examiner*—Roy Lake
*Assistant Examiner*—Neil Abrams
*Attorney, Agent, or Firm*—James W. Pearce; Roy F. Schaeperklaus

[57] ABSTRACT

An end fitting retainer for welding equipment which holds a cable end fitting on a connector stud. The retainer includes a nut for threadably engaging the stud. A housing rotatably supports the nut. Guard members in a socket in the housing surrounding the head end of the nut overlie the nut. An opening in the guard members permits a wrench to turn the nut but prevents entry of a finger. A flange on the nut engages flanges on the guard members to hold the guard members in the socket. Interconnecting means on the housing and on the nut retains the nut in the housing.

8 Claims, 7 Drawing Figures

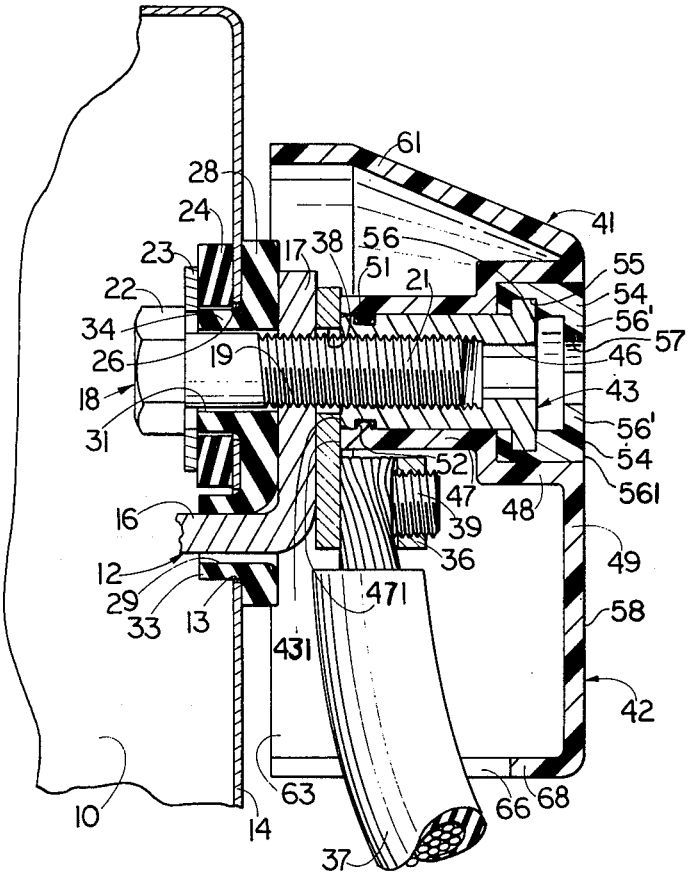
FIG. 6
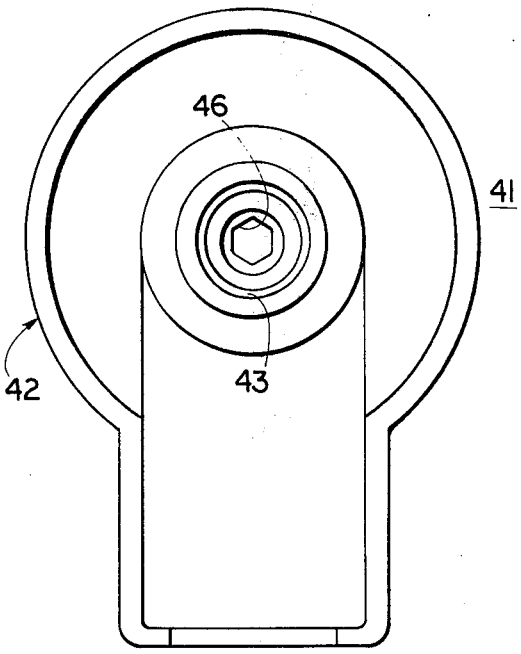
FIG. 5
FIG 7
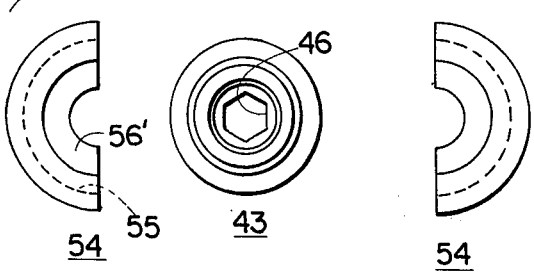

RETAINER FOR AN END FITTING OF A WELDING CABLE

This invention relates to welding machines. More particularly, this invention relates to a cap or cover for retaining a cable end fitting on an electrical connector of a cabinet for welding equipment.

In welding equipment, it is common to have a housing or cabinet on which terminals or connectors for welding cables are mounted. An object of this invention is to provide a cover for such a cable connector which protects the cable connector from touching both when a cable is connected thereto and when there is no cable connected to the cable connector.

A further object of this invention is to provide such a cover which acts to hold a cable end fitting on the cable connector.

A further object of this invention is to provide such a cover which encloses electrically charged elements connected to the cable connector.

Briefly, this invention provides a cover for a cable connector which includes a hollow body or housing of dielectric material which fits over the cable connector and a nut rotatably mounted in the body which can be threaded on a stud of the cable connector to hold a cable end fitting on the cable connector. The nut is held in place in a tubular portion of the body by means of interacting shoulders on the nut and on the tubular portion. A head end of the nut includes an outwardly extending flange which is received in a pair of nut-protecting guard members which are slotted to receive the flange. The nut protecting members are received in a countersunk section of the tubular portion. Inwardly directed flanges on the nut-protecting guard members cooperate to form an inwardly directed annular structure preventing touching of the nut but permitting entry of a tool for turning the nut.

The above and other objects and features of the invention will be apparent to those skilled in the art to which this invention pertains from the following detailed description and the drawings, in which:

FIG. 5 is a view looking in the direction of the arrows 5—5 in FIG. 3;

FIG. 6 is a view in section taken on the line 6—6 in FIG. 1, the wrench being removed; and FIG. 7 is an exploded view showing a nut and a pair of guard members of the retainer prior to assembly.

In the following detailed description and the drawings, like reference characters indicate like parts.

Figure 1:
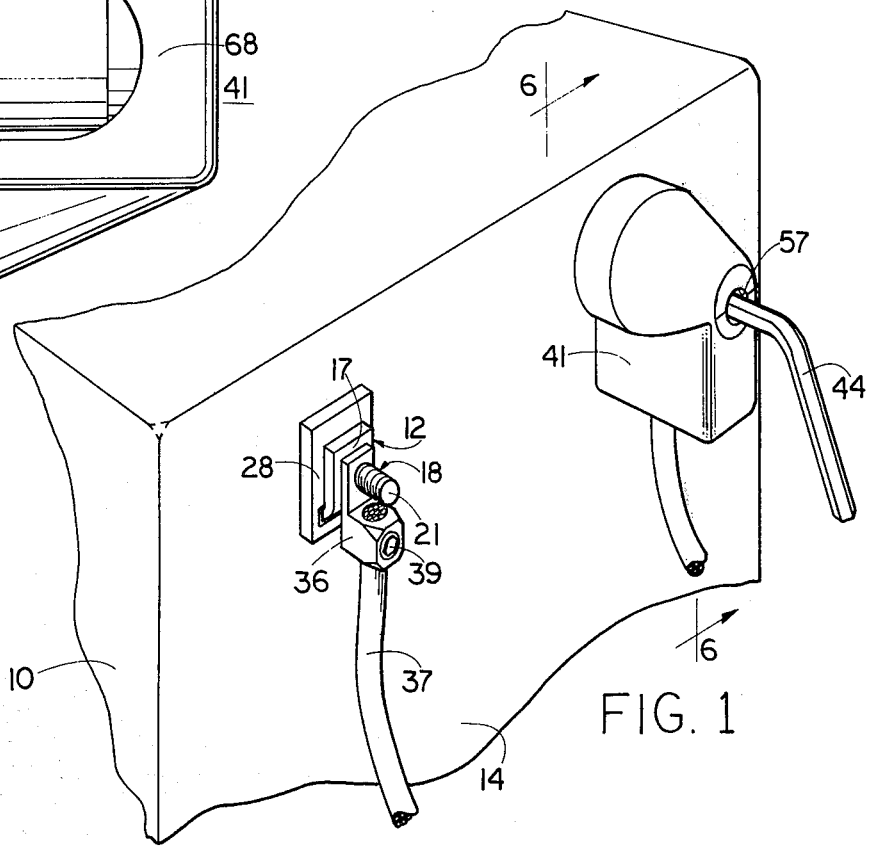
FIG. 1 is a fragmentary perspective view showing a portion of a welding cabinet having cable connectors mounted thereon, a protective retainer for a cable end fitting constructed in accordance with an embodiment of this invention, portions of two welding cables and a wrench being shown in association therewith.

In FIG. 1 is shown a welding cabinet 10 inside which appropriate electrical welding apparatus (not shown) is mounted in the usual fashion. Bus bars 12, one of which is shown in FIG. 1, extend outwardly through slots 13, one of which is shown in FIG. 6, in a front panel 14 of the cabinet 10. Each bus bar 12 includes a horizontal portion 16 which extends through the slot 13 spaced from edges thereof and a flange 17 which extends upwardly from the portion 16 parallel to the front panel 14. A bolt or stud member 18 having a horizontal axis is threaded in an opening 19 in the flange 17 with a threaded shank 21 thereof extending outwardly of the cabinet 10. A head 22 of the stud 18 is disposed inside the cabinet 10 and bears on a washer 23 which, in turn, bears on an insulating washer 24 which engages the front panel 14 with the stud 18 extending through a transverse bore 26 in the panel 14 spaced from edges thereof. An insulating plate 28 is mounted between the flange 17 and the panel 14 to prevent electrical contact therebetween. A slot 29 in the insulating plate 28 receives the horizontal portion 16 of the bus bar 12. An opening 31 in the insulating plate 28 receives the shank 21 of the stud 18. Skirts 33 and 34 on the insulating plate 28 surrounding the slot 29 and the opening 31, respectively, are received in the slot 13 and the bore 26 of the front panel 14 to prevent contact between the bus bar 12 and the stud 18, respectively, and the front panel 14. A cable end fitting 36 of a cable 37 can be mounted on the shank 21 of the stud 18 with the shank 21 extending through an opening 38 in the end fitting 36. The end fitting 36 can be held on conductor strands of the cable 37 by a set screw 39. The structure which has been described to this point can be conventional.

Figure 2:
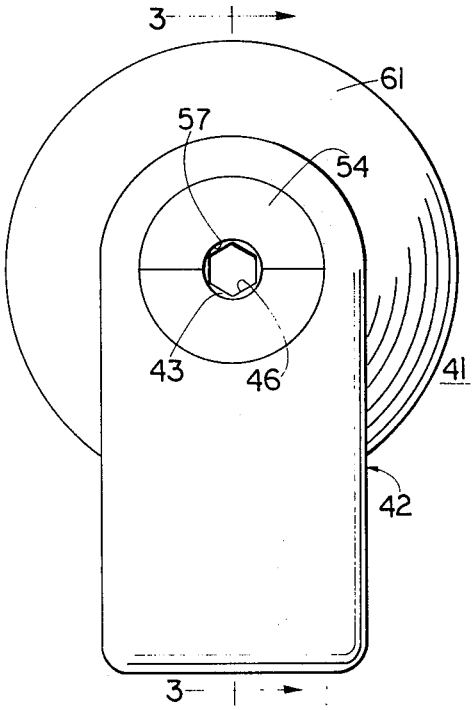
FIG. 2 is a view in side elevation of the retainer shown in FIG. 1.

A protective end fitting retainer and guard 41 constructed in accordance with an embodiment of this invention is shown in FIGS. 1 and 6. The end fitting retainer 41 includes a housing 42 of electrically insulating material in which a nut 43 is rotatably mounted. The nut 43 can be threaded on the shank 21 of the stud 18 and can be turned by means of a wrench 44 (FIG. 1) which can be received in a socket 46 (FIGS. 2, 3, and 6) at a head end portion of the nut 43. The nut 43 can be advanced to the position shown in FIG. 6 at which the nut 43 holds the cable end fitting 36 firmly in place on the shank 21 of the stud 18 and against the flange 17 of the bus bar 12.

Figure 3:
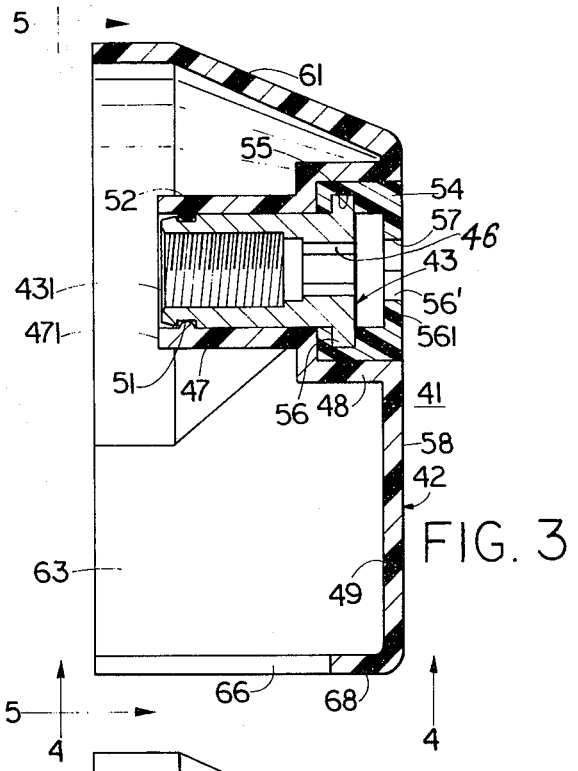
FIG. 3 is a view in section taken on the line 3—3 in FIG. 2.

The nut 43 is rotatably mounted inside a tubular portion or skirt 47 which is provided with an outer countersunk section 48 of enlarged diameter. The tubular portion 47 is supported on and is integral with an outer wall 49 of the housing 42. An annular inwardly directed flange 51 on the tubular portion 47 extends into an annular slot 52 in the nut 43 to hold the nut 43 in position inside the tubular portion 47. As shown in FIG. 3, an inner end 471 of the tubular portion 47 normally extends inwardly beyond an inner end 431 of the nut 43. However, the material of the tubular portion is sufficiently resilient that when the nut 43 is drawn up on the bolt 18 as shown in FIG. 6, both the inner end 471 of the tubular portion 47 and the inner end 431 of the nut 43 engage the cable end fitting 36.

The head end of the nut 43 is guarded by a pair of guard members 54 (FIG. 7) which are received in the enlarged or outer countersunk section 48 of the tubular portion 47. Each of the guard members 54 is of electrically insulating material and is provided with an arcuate slot 55 which receives a one-half portion of an outwardly extending annular flange 56 of the nut 43 with the nut 43 holding the guard members in position inside the countersunk section 48 of the tubular portion 47 as shown in FIG. 3. Inwardly directed flanges 56' on the guard members define a small circular opening 57. The flanges 56' overlie the head of the nut 43 with outer faces 561 of the flanges 56' aligned with an outer face 58 of the wall 49 of the housing 42. The opening 57 is sufficiently large to permit entry of an end of the wrench 44 (FIG. 1) but insufficiently large to permit entry of a finger or the like so that the end fitting retainer prevents engagement by an operator (not shown) of electrically charged elements while holding the end fitting 36 in position on the stud 18.

Figure 4:
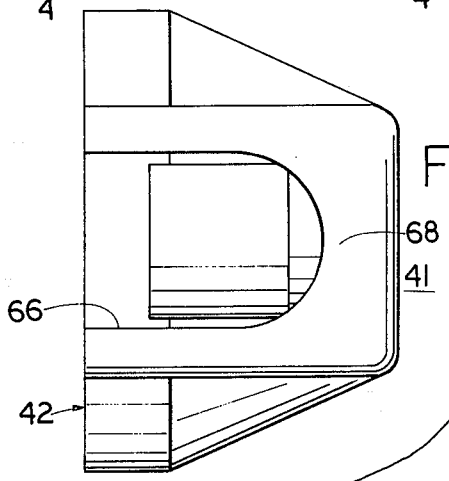
FIG. 4 is a bottom plan view of the retainer looking in the direction of the arrows 4—4 in FIG. 3.

The housing 42 (FIGS. 2 and 3) is hollow and includes a generally frusto-conic wall section 61 surrounding the skirt 47 and extending to adjacent the front panel 14, as shown in FIG. 6, when the end fitting retainer 41 is in operative position. Side wall sections 63 of the housing 42 extend downwardly from the frusto-conic section 61 on opposite sides of an upper end portion of the cable 37 with a slot 66 (FIG. 4) in a lower wall 68 of the housing receiving the cable 37, as shown in FIG. 6. The cable 37 is engageable by sides of the slot 66 to prevent turning of the housing 42 as the nut 43 is turned.

The end fitting retainer holds the cable end fitting 36 firmly in position on the stud 18 and protects all charged members from inadvertent engagement by the operator of the welding equipment. When the cable 37 is removed, the end fitting retainer can be mounted on the stud 18 to provide protection against potentially charged members when the cable is disconnected.

In the drawing the nut 43 is shown retained in the tubular portion 47 of the housing 42 by means of the flange 51 on the interior of the tubular portion 47, but other means may be employed for retaining the nut 43 inside the tubular portion 47 for rotation therein. The nut so retained, in turn retains the guard members 54 in protecting relation to the nut in recess 48.

The end fitting retainer illustrated in the drawings and described above is subject to structural modification without departing from the spirit and scope of the appended claims.

Having described my invention, what I claim as new and desire to secure by letters patent is:

1. An end fitting retainer for welding equipment including a cabinet and a stud extending outwardly of the cabinet which comprises a nut for threadably engaging the stud, said nut having a head end, means on said head end for cooperation with a wrench, an insulative housing rotatably supporting the nut, there being a socket in the housing surrounding said head end of the nut, a flange on said head end of the nut extending radially outwardly thereof, guard means mounted in the socket, there being an opening in the guard means overlying the head end of the nut of a sufficient size to permit entry of a wrench to contact said means on said head end without permitting entry of a finger, flange means on the guard means underlying the flange of the nut to hold the guard means on the nut and in the socket, and means on the housing cooperating with means on the nut for retaining the nut in the housing.

2. An end fitting retainer as in claim 1 wherein the guard means includes a pair of guard members and each of the guard members includes a flange underlying the flange of the nut.

3. An end fitting retainer as in claim 1 wherein the housing includes walls which are closedly spaced from the cabinet when the nut holds a cable end fitting on the stud.

4. An end fitting retainer as in claim 3 wherein there is a slot in the housing for receiving a cable attached to the end fitting and edges of the slot are engageable with the cable to prevent turning of the housing as the nut is turned.

5. The combination of a welding cabinet including a front wall panel, a bus bar having a portion extending through an opening in the front wall panel and a stud mounted on the bus bar and extending outwardly of the front wall panel, a cable, and an end fitting mounted on the cable and received on the stud with an end fitting retainer which comprises a nut threadably engaging the stud, said nut having a head end, means on said head end for cooperation with a wrench, an insulative housing rotatably supporting the nut, there being a socket in the housing surrounding said head end of the nut, a flange on said head end of the nut extending radially outwardly thereof, guard means mounted in the socket, there being an opening in the guard means overlying the head end of the nut of a sufficient size to permit entry of a wrench to contact said means on said head end without permitting entry of a finger, flange means on the guard means underlying the flange of the nut to hold the guard means on the nut and in the socket, and means on the housing cooperating with means on the nut for retaining the nut in the housing.

6. A combination as in claim 5 wherein the guard means includes a pair of guard members and each of the guard members includes a flange underlying the flange of the nut.

7. A combination as in claim 5 wherein the housing includes walls which are closely spaced from the front wall panel when the nut holds the cable end fitting on the stud.

8. A combination as in claim 7 wherein there is a slot in the housing receiving the cable and edges of the slot are engageable with the cable to prevent turning of the housing as the nut is turned.

* * * * *